US006324841B1

(12) United States Patent
Beutler et al.

(10) Patent No.: US 6,324,841 B1
(45) Date of Patent: Dec. 4, 2001

(54) POWER- AND MOMENT-REGULATING SYSTEM FOR A PLURALITY OF HYDRAULIC PUMPS

(75) Inventors: Gerhard Beutler, Nagold; Hermann Maier, Waldachtal, both of (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/269,252

(22) PCT Filed: Sep. 15, 1997

(86) PCT No.: PCT/EP97/05047

§ 371 Date: Mar. 23, 1999

§ 102(e) Date: Mar. 23, 1999

(87) PCT Pub. No.: WO98/19069

PCT Pub. Date: May 7, 1998

(30) Foreign Application Priority Data

Oct. 31, 1996 (DE) ..... 196 45 014
Nov. 12, 1996 (DE) ..... 196 46 687

(51) Int. Cl.[7] ..... F04B 49/00
(52) U.S. Cl. ..... 60/452; 417/213
(58) Field of Search ..... 60/428, 445, 452; 417/213

(56) References Cited

U.S. PATENT DOCUMENTS 4,613,286 9/1986 Ishikawa .
4,668,171 * 5/1987 Beutler et al. ..... 417/213
5,562,424 10/1996 Manring .
5,567,123 10/1996 Childress et al. .

FOREIGN PATENT DOCUMENTS 2 216 680 10/1973 (DE) .
3345264 A1 6/1985 (DE) .
0 149 787 B2 7/1985 (EP) .
WO 95/22694 8/1995 (WO) .

* cited by examiner

*Primary Examiner*—F. Daniel Lopez
(74) *Attorney, Agent, or Firm*—Scully, Scott & Murphy & Presser

(57) ABSTRACT

A power- and moment-regulating system for at least two adjustable hydraulic pumps (10, 11). A hydraulic servo control apparatus (22, 23) continuously adjusts delivery as a function of pressure in a delivery pressure line (16, 17) and pressures in control lines (20, 21). Each servo control apparatus (22, 23) is provided with a moment valve (42, 43) having a valve piston (62) which moves in a valve sleeve (61) forming a valve seat and whose closure force is determined by a measuring spring (46, 47) which is connected to pump actuator (37, 38) and is preloaded depending upon the set delivery rate. The pressure in control line (20, 21) or pressure in control lines of the other hydraulic pump(s) (11, 10) act both on the valve piston (62) and on valve screen (61) of moment valve (42, 43) associated with the given hydraulic pump (10, 11).

9 Claims, 3 Drawing Sheets

POWER- AND MOMENT-REGULATING SYSTEM FOR A PLURALITY OF HYDRAULIC PUMPS

The invention relates to an output- and/or torque-regulating device for at least two adjustable hydraulic pumps having in each case one hydraulic servo control unit per hydraulic pump for infinitely variable adjustment of the delivery rate.

An output- and/or torque-regulating device of the type described is known, for example, from EP 0149 787 B2. In the known output- and/or torque-regulating device, the delivery rate of each hydraulic pump is determined in dependence upon the delivery pressure of the respective hydraulic pump in a delivery pressure line associated with the hydraulic pump and upon the control pressures in control lines provided for each hydraulic pump. To said end, the servo control unit comprises a swing-out device setting a pump actuator in maximum delivery rate direction and a piston, which acts upon the pump actuator in the direction of a delivery rate reduction and the piston area of which is loadable with the delivery pressure or connectable to an outlet by means of a hydraulically operable control valve. Operation of the control valve is effected by the control pressure in the control line of the respective hydraulic pump. For each servo control unit there is provided a torque valve having a valve piston, which is movable in a valve sleeve and forms a sealing fit with the valve sleeve and the closing force of which is determined by a measuring spring arrangement, which is connected to the pump actuator and preloaded in dependence upon the set delivery rate. Said torque valve of the two hydraulic pumps connects the control line of the associated hydraulic pump in dependence upon the control pressure in said control line and upon the control pressure in the control line of the other hydraulic pump to the outlet with simultaneous preloading of the measuring spring arrangement.

Figure 2:
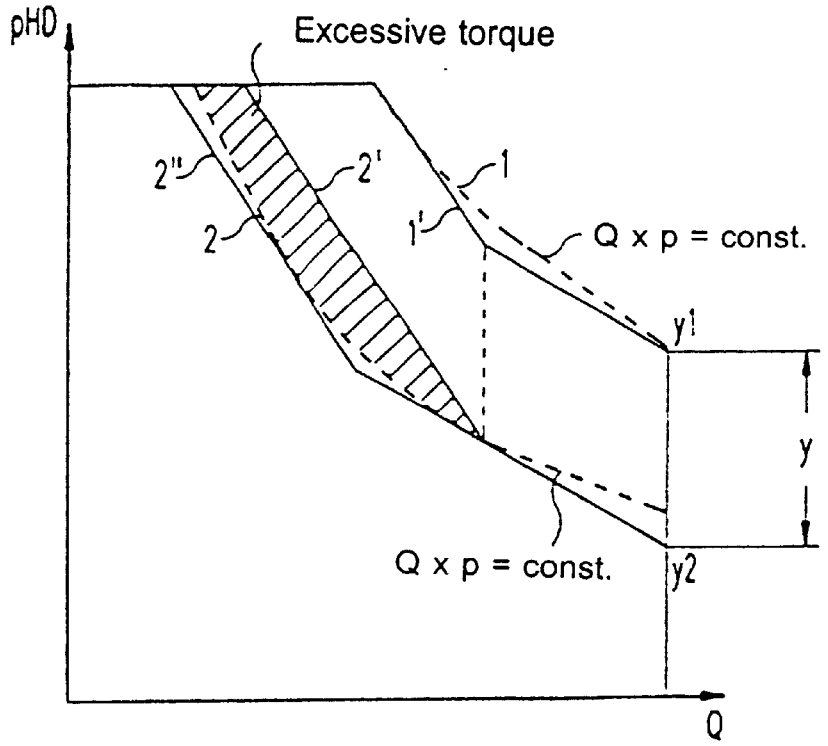
Prior art Fig. 2

The characteristic of said known output- and/or torque-regulating device is illustrated in FIG. 2 as a function of the high pressure pHD prevailing in the delivery pressure line in dependence upon the delivery rate Q of the associated hydraulic pump. An ideal output characteristic curve of one of the two hydraulic pumps given a disconnected consumer in the pressure circuit of the other hydraulic pump is denoted by the reference character 1. In the case of said hyperbolic ideal characteristic curve 1 with constant output, the product of delivery rate Q and pressure pHD in the high-pressure line is constant and the curve therefore has a hyperbolic shape. In the case of the regulating device known from EP 0149 787 B2, the ideal characteristic curve 1 is approximated by a real characteristic curve 1'. The real characteristic curve 1' has two linear portions. In each of the linear portions, the closing force of the valve piston of the torque valve is determined by one of two individual springs provided in the measuring spring arrangement of the torque valve. In said manner, the hyperbolic shape of the ideal characteristic curve 1 may be approximated sufficiently for practical needs.

When a consumer, e.g. a digger controller, is then connected in the pressure circuit of the other hydraulic pump, in the case of the regulating device known from EP 0149 787 B2 the torque valve provided in the servo control unit of the first hydraulic pump is additionally acted upon by a control line connected to the second hydraulic pump. This occurs in the regulating device known from EP 0149 787 B2 in that the valve piston of the torque valve is additionally loaded in opening direction against the measuring spring arrangement. In the P-Q diagram illustrated in FIG. 2, this corresponds to a parallel displacement of the characteristic curve 1' in y direction, which is illustrated by the vector y. As a result of the connection of the consumer in the pressure circuit of the second hydraulic pump, the original characteristic curve 1' of the first hydraulic pump is transformed into the characteristic curve 2'. In the region of a relatively low delivery rate Q and/or in the region of a relatively high pressure pHD in the delivery pressure line, this however leads to a considerable deviation from the corresponding ideal characteristic curve 2 with constant output (Q×p=constant). In said region an excessive torque arises, which is illustrated in FIG. 2 by the hatched area. This may lead to an overloading of the first hydraulic pump and/or of the drive unit. A better approximation would result from the, in sections, linearized characteristic curve 2", which is however not achievable with the regulating device known from EP 0 149 787 B2.

The relatively large deviation from the ideal characteristic curve (Q×p=constant) which is illustrated in FIG. 2 may admittedly be avoided in principle by the use of a very costly, so-called hyperbolic output regulator or by electronically operating, e.g. microprocessor-controlled output regulators. The constructional outlay for such solutions and the associated manufacturing costs are however considerable and out of all proportion to the relatively low outlay for an output and/or torque-regulating device of the type described, such as is known, for example, from EP 0149 787 B2.

The object of the present invention is therefore to develop an output- and/or torque-regulating device of the type described in such a way that a better approximation to the ideal regulating characteristic curve is achieved.

Said object is achieved by the characterizing features in conjunction with the generic features.

The invention is based on the discovery that a far better approximation to the ideal characteristic curve may be achieved when not only the valve piston but also the valve sleeve of the torque valve are acted upon in a suitable manner by the control pressure and/or control pressures derived from the delivery pressure of the second hydraulic pump and/or the delivery pressures of the further hydraulic pumps provided in any desired number.

The advantages of the present invention are achieved in the following way.

For each control line there can be provided on the valve piston of each torque valve an associated measuring surface, which can be loaded by, in each case, the control pressure of the associated control line in the direction of opening of the torque valve. There can be provided on the pump actuator a driver pin which acts in the valve sleeve of the associated torque valve to vary the preloading of the measuring spring arrangement.

The control pressure prevailing in each case in the control line of the other hydraulic pump can act upon a valve sleeve-positioning piston in such a way that the valve sleeve-positioning piston displaces the valve sleeve against a restoring spring. It is advantageous when the direction of motion of the valve sleeve-positioning piston is directed substantially at right angles to the direction of motion of the valve sleeve because this enables a particularly compact structural design of the torque valve. An intermediate element can be provided between the valve sleeve-positioning piston and the valve sleeve. The contact surface between the valve sleeve-positioning piston and the intermediate element can compensate the displacement of the valve sleeve at right angles to the direction of motion of the valve sleeve-positioning piston when the intermediate element is guided simultaneously with the valve sleeve.

The valve sleeve-positioning piston or the intermediate element can have an oblique surface, which acts upon a bolt element in engagement with the valve sleeve. By virtue of the oblique surface, a deflection of the direction of motion of the valve sleeve-positioning piston into the direction of motion of the valve sleeve is achieved. By suitably dimensioning the angle of the oblique surface, a reduction ratio can be achieved. The driver pin of the pump actuator can take the form of a hollow body, including a hollow cylinder, the valve sleeve-positioning piston or the intermediate element engaging displaceably into the driver pin of the pump actuator and being enclosed by the driver pin. Said measure also results in a particularly compact design of the torque valve. In order for the bolt element to be applied against the oblique surface of the valve sleeve-positioning piston or intermediate element, the driver pin can have a suitable recess in the region of the oblique surface.

Figure 1:
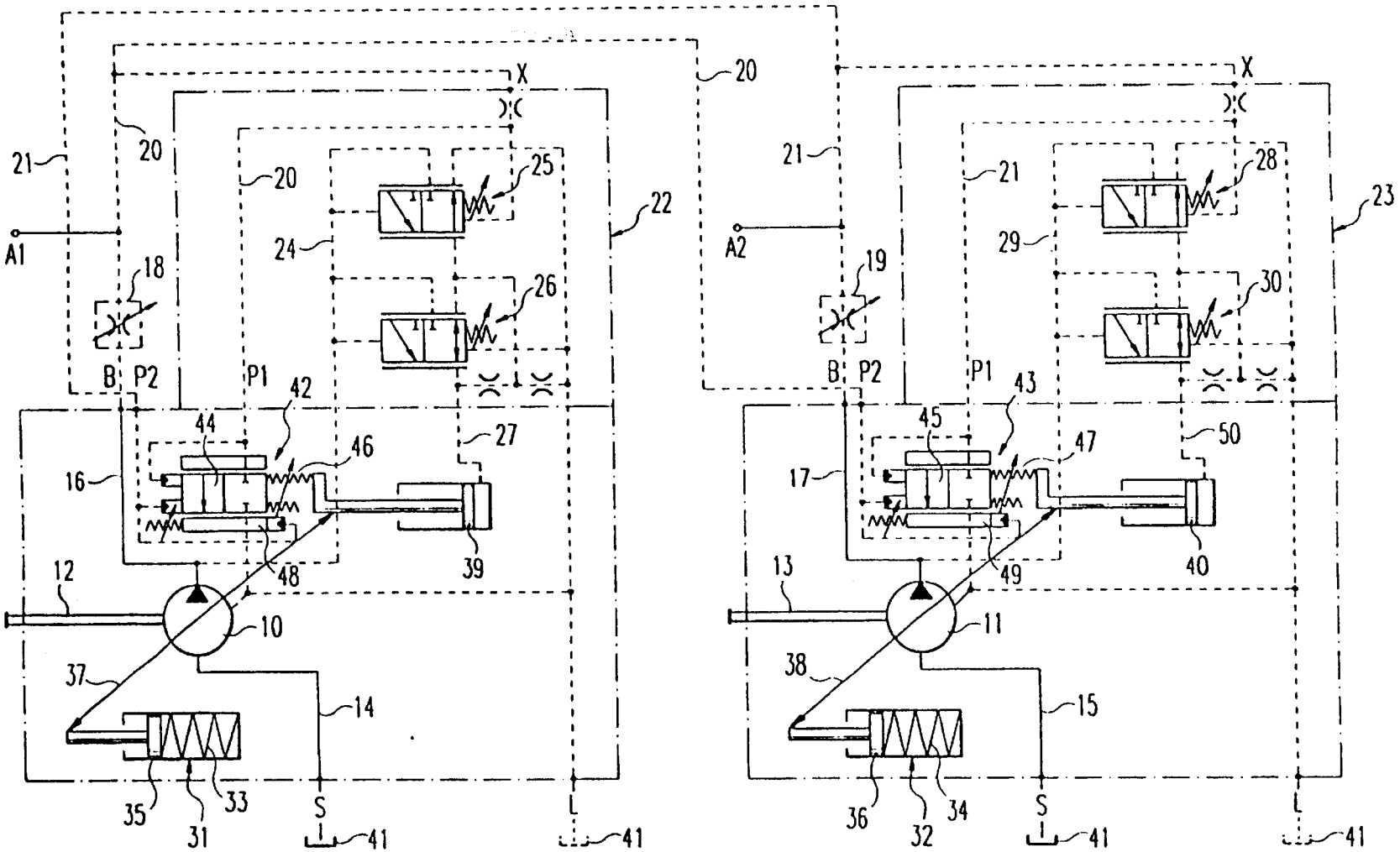
Figure 3:
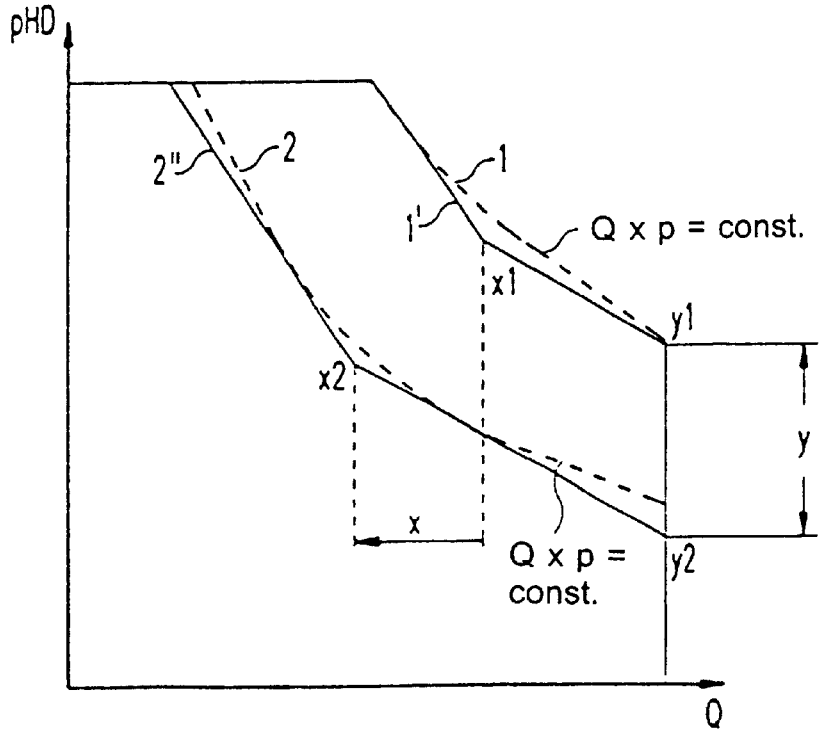
Figure 4:
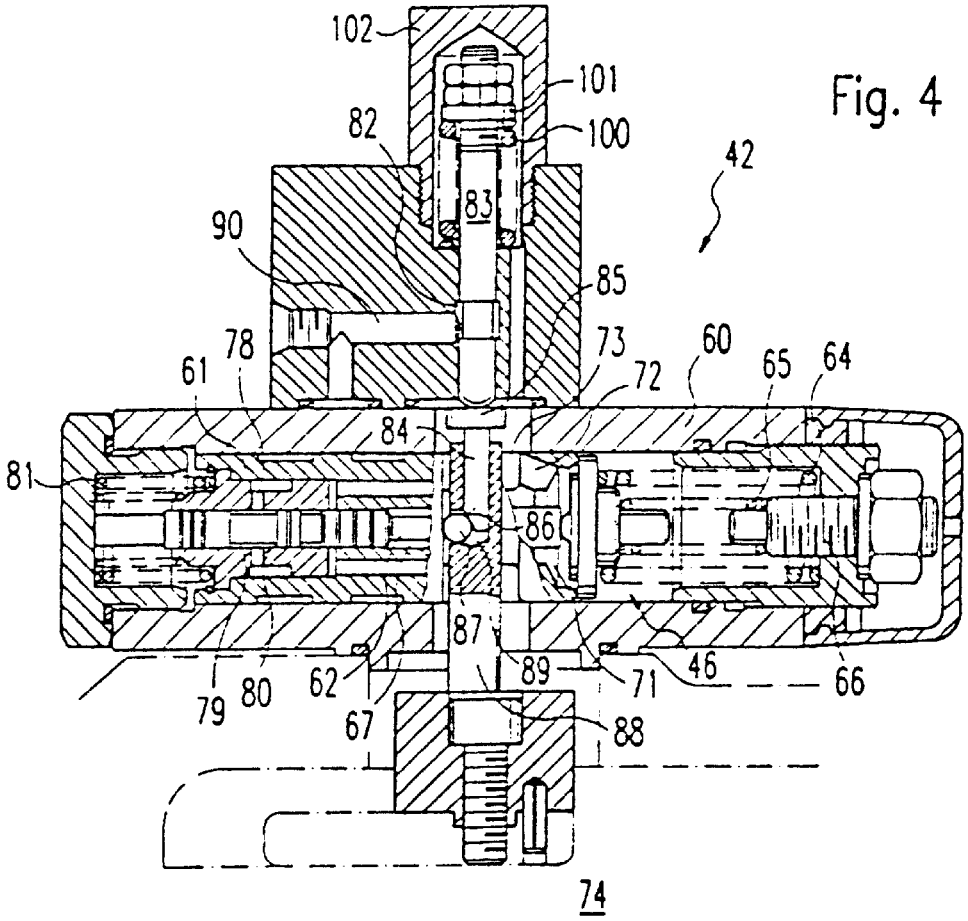
Figure 5:
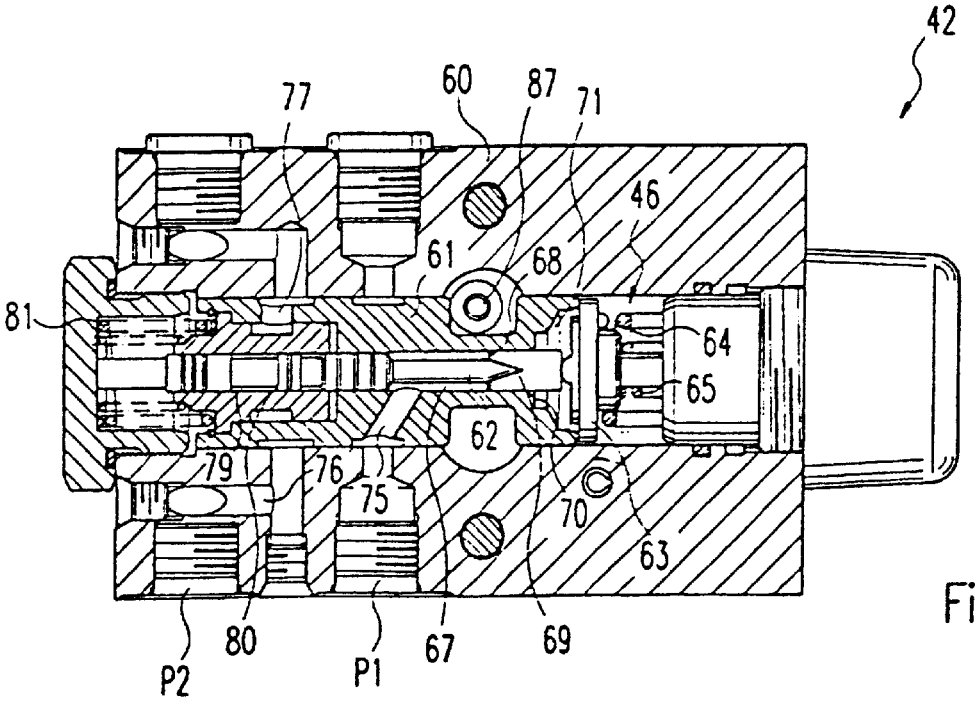

A preferred embodiment of the invention is described below in detail with reference to the drawings. Said drawings show:

FIG. 1 a hydraulic connection diagram of the output- and/or torque-regulating device according to the invention;

FIG. 2 the regulating characteristic of an output- and/or torque regulating device according to prior art;

FIG. 3 the regulating characteristic of an output- and/or torque-regulating device developed according to the invention;

FIG. 4 a vertical section through a torque valve used in the output- and/or torque-regulating device according to the invention; and FIG. 5 a horizontal section through a torque valve according to the invention as in FIG. 4.

FIG. 1 shows a hydraulic connection diagram, which diagrammatically illustrates an embodiment of the output- and/or torque-regulating device according to the invention. In the embodiment shown in FIG. 1, an output- and/or torque-regulating device according to the invention is used to control two hydraulic pumps 10 and 11. The output- and/or torque-regulating device according to the invention is however also suitable for controlling more than two hydraulic pumps in an identical manner.

The basic mode of operation of the output- and/or torque-regulating device, apart from the development according to the invention, is known from and described in full in EP 0149 787 B2. Express reference is therefore made to said publication. However, in order to make it easier to understand the present invention, there now follows a brief description of the basic mode of operation of the generic output- and/or torque-regulating device.

The hydraulic pumps 10 and 11 are driven in each case via a drive shaft 12 and 13 by a drive unit, which is not shown. The hydraulic pumps 10 and 11 in each case take in pressure fluid, e.g. oil, from a pressure fluid tank 41 via an intake line 14 or 15 and deliver the pressure fluid to a delivery pressure line 16 or 17, where it is available for a consumer connectable to the connection B. Control lines 20 and 21 are connected by preferably adjustable throttle elements 18 and 19 to the outputs B connected to the delivery pressure lines 16 and 17. Situated downstream of the throttle elements 18 and 19 are also the working connections A1 and A2—connectable to working lines—of the hydraulic pumps 10 and 11. The control line 20 of the first hydraulic pump 10 is connected to the input X of the servo control unit 22 of the first hydraulic pump 10 and to the input P2 of the servo control unit 23 of the second hydraulic pump 11. Analogously, the control line 21 of the second hydraulic pump 11 is connected to the input X of the servo control unit 23 of the second hydraulic pump and to the input P2 of the servo control unit 22 of the first hydraulic pump 10. The control pressure prevailing in the control line 20 is compared in a control valve 25 in the form of a pressure balance with the delivery pressure prevailing in the delivery pressure line 16. To said end, the control valve is connected by a connecting line 24 to the delivery pressure line 16. Disposed downstream of the control valve 25 is a pressure relief valve 26 for limiting the pressure in the actuating pressure line 27. Similarly, the servo control unit 23 of the second hydraulic pump 11 is provided with a control valve 28 operating in any case as a pressure balance, which compares the pressure in the control line 21 with the delivery pressure in the delivery pressure line 17. To said end, the control valve 28 is connected by a connecting line 29 to the delivery pressure line 17 of the second hydraulic pump 11. A pressure relief valve 30 is likewise disposed downstream of the control valve 28 for limiting the pressure in the actuating pressure line 50.

The first hydraulic pump 10 is swung out by a swing-out device 31 in maximum delivery rate direction, while the second hydraulic pump 11 is swung out by a swing-out device 32 likewise in maximum delivery rate direction. In the embodiment, the swing-out device 31 or 32 comprises a piston 35 or 36 which is loadable against a spring 33 or 34. The swing-out device 31 or 32 acts upon a pump actuator 37 or 38, which sets the delivery rate of the hydraulic pump 10 or 11. A hydraulically loadable piston 39 or 40 is used to restore the pump actuator 37 or 38 in the direction of a delivery rate reduction. The piston 39 or 40 is loaded by the actuating pressure prevailing in the actuating pressure line 27 or 50.

Upon an increase in the delivery pressure prevailing in the delivery pressure line 16 or 17 relative to the control pressure prevailing in the control line 20 or 21, the control valve 25 or 28 operating as a pressure balance increases the actuating pressure in the actuating pressure line 27 or 50 and so the hydraulic pump 10 or 11 is swung back in the direction of a delivery rate reduction until it reaches a position of equilibrium.

The control line 20 or 21 is connected by a torque valve 42 or 43 to the pressure fluid tank 41. The valve piston 44 or 45 of the torque valve 42 or 43 is loaded in opening direction, on the one hand, by the control pressure in the control line 20 or 21 of the, in each case, associated hydraulic pump 10 or 11 and, on the other hand, by the control pressure in the control line 21 or 20 of the, in each case, other hydraulic pump 11 or 10. A measuring spring arrangement 46 or 47, which in the embodiment comprises two individual springs, acts in closing direction upon the valve piston 44 or 45 in order to produce the, in sections, linear characteristic curve shape already described with reference to FIG. 2. The preloading of the measuring spring arrangement 46 or 47 is determined by the position of the pump actuator 37 or 38.

When the control pressure in the control line 20 or the control pressure in the control line 21 reaches the value adjusted at the torque valve 42 or 43, the torque valve 42 or 43 starts to open and there is a pressure drop at the throttle element 18 or 19. Consequently, the control valve 25 or 28 is opened further and supplies the piston 39 or 40 with an increased actuating pressure, with the result that said piston attempts to displace the pump actuator 37 or 38 in the direction of a reduced delivery rate. In the process, the measuring spring of the measuring spring arrangement 46 or 47 of the torque valve 42 or 43 is preloaded. In said manner, a constant output regulation is achieved.

In accordance with the development according to the invention, the valve sleeve 48 or 49 is also acted upon by the control pressure prevailing in the control line 21 or 20 of the, in each case, other hydraulic pump 11 or 10. Said development according to the invention results in a better approximation of the regulating characteristic of the output- and/or torque-regulating device to the ideally hyperbolic shape. This is described below in detail with reference to FIG. 3.

In a similar manner to FIG. 2, FIG. 3 shows the delivery pressure pHD prevailing in the delivery pressure line 16 as a function of the delivery rate Q of the first hydraulic pump 10 or 11. Provided that the consumer connected to the delivery pressure line 17 of the second hydraulic pump 11 has only a low power requirement and the second hydraulic pump 11 i s therefore only slightly loaded, the first hydraulic pump 10 is regulated to an approximately constant output along the real characteristic curve 1' approximated to the ideal characteristic curve 1. When the second hydraulic pump 11 has a significant power output, the power output of the first hydraulic pump 10 has to be reduced in order to prevent the total power output of the hydraulic pumps 10 and 11 from exceeding a preset maximum value and to prevent overloading of a drive unit which drives the hydraulic pumps 10 and 11. By virtue of the loading of the valve piston 44 of the torque valve 42, the parallel displacement in y direction illustrated by the vector y, i.e. a reduction of the delivery pressure of the hydraulic pump 10, is realized. By virtue of the simultaneous loading of the valve sleeve 48 of the torque valve 42, however, a reduction of the delivery rate of the hydraulic pump 10 is also realized, which leads to a parallel displacement in x direction illustrated by the vector x.

As is immediately evident from a comparison of the regulating characteristic of a generic output- and/or torque-regulating device, which is shown in FIG. 2, with the characteristic of the output- and/or torque regulating device developed according to the invention, which is shown in FIG. 3, the development according to the invention leads to a better approximation of the regulating curve 2" to the ideal regulating characteristic curve 2.

There follows a description of an embodiment of the torque valve 42 or 43 developed according to the invention with reference to FIGS. 4 and 5. FIG. 4 shows a vertical longitudinal section through the torque valve 42, while FIG. 5 shows a horizontal longitudinal section through the torque valve 42. As the torque valves 42 and 43 are identical in construction, the following description is confined to the torque valve 42.

The torque valve 42 comprises a valve housing 60, a valve sleeve 61 disposed in an axially movable manner in the valve housing 60, and a valve piston 62 movable relative to the valve sleeve 61. The valve piston 62 via a spring cup 63 is loaded in closing direction by the measuring spring arrangement 46. The measuring spring arrangement 46 in the embodiment comprises two individual springs 64 and 65 disposed one inside the other, which results in the, in sections, linear regulating characteristic shown in FIG. 3. The preloading of the spring assembly 46 is adjustable by means of a spring bolt 66. For the control line 20 a first pressure medium connection P1 and for the control line 21 a second pressure medium connection P2 is provided in the valve housing 60. The pressure medium connection P1 connected to the control line 20 is connected by a connecting channel 75 to a first pressure chamber 67. Upon loading of the first pressure chamber 67 with the control pressure prevailing in the control line 20, a first measuring surface 68 is loaded in the direction of opening of the torque valve 42 by the control pressure prevailing in the control line 20. As soon as the tip 69 reaches the control edge 70, the torque valve 46 opens the control line 20 in the direction of the pressure fluid tank 41. To said end, the stepped bore 71 is connected by a connecting channel 72 to the transverse bore 73 so that the pressure fluid may flow off into the leakage space 74.

The control line 21 connected to the pressure medium connection P2 is connected by a connecting channel 76 and by further connecting channels 77 and 78 to a second pressure chamber 79, on which a second measuring surface 80 is formed. The control pressure prevailing in the control line 21 therefore loads the valve piston 72 likewise in the direction of opening of the torque valve 42.

As already described, the control pressure prevailing in the control line 21 acts not only upon the valve piston 62 but also additionally upon the valve sleeve 61 in order to displace the latter axially against a restoring spring 81 and the measuring spring arrangement 46 in dependence upon the control pressure prevailing in the control line 21. To said end, a third pressure chamber 82 is connected by an only partially illustrated connecting channel 90 to the second pressure medium connection P2. The control pressure of the second control line 21 prevailing in the pressure chamber 82 therefore loads a valve sleeve-positioning piston 83. In the preferred embodiment illustrated in FIGS. 4 and 5, the direction of motion of the valve sleeve-positioning piston 83 is aligned at right angles to the direction of motion of the valve sleeve 61. This leads to a particularly compact design of the torque valve 42 according to the invention. The valve sleeve-positioning piston 83 in said case acts upon an intermediate element 84, which has a plate-like front end 85. At its opposite end to the plate-like front end 85, the intermediate element 84 has an oblique surface 86, which acts upon a bolt element 87 formed on the valve sleeve 61. By means of a suitable, flat angle of inclination of the oblique surface 87 it is possible, where necessary, to achieve a reduction ratio between the motion of the valve sleeve-positioning piston 83 and the motion of the valve sleeve 61. The intermediate element 84 in the illustrated embodiment is disposed inside a driver pin 88 in the form of a hollow cylinder, which is connected in a suitable manner to the pump actuator 37. The driver pin 88 has a recess 89 for receiving the bolt element 87 so that the bolt element 87 lies flush against the oblique surface 86 of the intermediate element 84.

The valve sleeve-positioning piston 83 at its opposite end to the driver pin 88 is preloaded by a positioning spring 100 in such a way that the valve sleeve-positioning piston 83, when not loaded by the control pressure prevailing in the control line 21, is pressed—in FIG. 4—upwards. In said manner, a restoring of the valve sleeve-positioning piston 83 is achieved. The preloading of the positioning spring 100 is adjustable by adjusting the spring cup 101. In said case, the adjustment of the spring cup 101 is accessible from the outside after removal of a housing sleeve 102.

By virtue of a horizontal displacement of the driver pin 88, the pump actuator 3 acts likewise upon the valve sleeve 61. In said case, the plate-like end 85 of the intermediate element 84 guarantees that the valve sleeve-positioning piston 83, despite the—in FIG. 4 —horizontal motion of the driver pin 88, is in continuous engagement with the intermediate element 84. As a result of the—in FIG. 4—vertical alignment of the direction of motion of the valve sleeve-positioning piston 83 at right angles to the direction of motion of the valve sleeve 61 and the driver pin 88, the displacement of the valve sleeve 61 may be effected by the driver pin 88, on the one hand, and by the valve sleeve-positioning piston 83, on the other hand, independently of one another.

The invention is not restricted to the illustrated embodiment. The torque valve may be designed in various different ways. In particular, the torque valve may have further measuring surfaces for the control lines of further hydraulic pumps controlled by the output- and/or torque-regulating device. In a corresponding manner, for each further hydraulic pump which is to be connected, a separate pressure chamber for each further additionally connectable hydraulic pump then has to be provided adjacent to the valve sleeve-positioning piston 83 or a corresponding number of valve sleeve-positioning pistons 83 have to be arranged in parallel.

What is claimed is:

1. Output- and/or torque-regulating device for at least two adjustable hydraulic pumps (10, 11) having in each case one hydraulic servo control unit (22, 23) per hydraulic pump (10, 11) for infinitely variable adjustment of the delivery rate, wherein the delivery rate of each hydraulic pump (10, 11) is determined by the pressure of the respective hydraulic pump (10,11) in a delivery pressure line (16, 17) associated with the hydraulic pump (10, 11) and by the pressures in control lines (20,21) provided for each hydraulic pump (10, 11), wherein each servo control unit (22, 23) comprises a swing-out device (31, 32) setting a pump actuator (37, 38) for maximum delivery rate and a piston (39, 40), which acts upon the pump actuator (37, 38) to reduce delivery rate and the piston area of which is loaded by the delivery pressure or connected to an outlet (41) by means of a hydraulically operated control valve (25, 28), and operation of the control valve (25, 28) is effected by the control pressure in the control line (20; 21) of the, in each case, associated hydraulic pump (10;11), wherein for each servo control unit (22, 23) there is provided a torque valve (42, 43) having a valve piston (62), which is moved in a valve sleeve (61) and forms a sealing fit with the valve sleeve (61) and the closing force which is determined by a measuring spring arrangement (4, 47), the measuring spring arrangement (4, 47) connected to the pump actuator (37, 38) and preloaded depending upon the set delivery rate, and wherein each torque valve (42; 43) connects the control line (20; 21) of the, in each case, associated hydraulic pump (10; 11) depending upon the pressure in said control line (20;21) and upon the control pressure in the control line (21; 20) or the control pressures in the control lines of the, in each case, other hydraulic pump(s) (11; 10) to the outlet (41) with simultaneous preloading of the measuring spring arrangement (46; 47), characterized in that for a specific hydraulic pump (10; 11) the control pressure in the control line (21; 20) or the control pressures in the control lines of the, in each case, other hydraulic pump(s) (11; 10) act(s) both upon the valve piston (62) and upon the valve sleeve (61) of the torque valve (42; 43) associated with the specific hydraulic pump (10; 11) and that the output- and/or torque-regulating device controls two adjustable hydraulic pumps (10,11) and in the torque valve (22; 23) of a specific hydraulic pump (10,11) the control line (21; 20) of the, in each case, other hydraulic pump (11; 10) loads a valve sleeve-positioning piston (83) with the control pressure prevailing in said control line (21; 20), with the result that the valve sleeve-positioning piston (83) displaces the valve sleeve (61) inside the valve housing (60) against a restoring spring (81) and/or the measuring spring arrangement (46; 47).

2. Output- and/or torque-regulating device according to claim 1 characterized in that on the valve piston (62) of each torque valve (42, 43) there is provided for each control line (20, 21) an associated measuring surface (68, 80), which is loaded by the control pressure of the, in each case, associated control line (20, 21) in the direction of opening of the torque valve (42, 43).

3. Output- and/or torque-regulating device according to claim 1 characterized in that a driver pin (88) of the pump actuator (37, 38) acts upon the valve sleeve (61) of the associated torque valve (42, 43) for varying the preloading of the measuring spring arrangement (46, 47).

4. Output- and/or torque-regulating device according to claim 1, characterized in that the restoring spring (81) acts upon the end of the valve sleeve (61) remote from the measuring spring arrangement (46).

5. Output- and/or torque-regulating device according to claim 1, characterized in that the direction of motion of the valve sleeve-positioning piston (83) is directed substantially at right angles to the direction of motion of the valve sleeve (61).

6. Output- and/or torque-regulating device according to claim 5, characterized in that an intermediate element (84) is provided between the valve sleeve-positioning piston (83) and the valve sleeve (61), said intermediate element (84) is frictionally connected both to the valve sleeve-positioning piston (83) and to the valve sleeve (61).

7. Output- and/or torque-regulating device according to claim 6, characterized in that one of the (a) valve sleeve-positioning piston (62) and (b) the intermediate element (84) has an oblique surface (86), which acts upon a bolt element (87) in engagement with the valve sleeve (61).

8. Output- and/or torque-regulating device according to claim 7, characterized in that the driver pin (88) takes the form of a hollow body and one of the (a) valve sleeve-positioning piston (83) and (b) the intermediate element (84) engages displaceably into the driver pin (88) of the pump actuator.

9. Output- and/or torque-regulating device according to claim 8, characterized in that one of the (a)driver pin (88) in the region of the oblique surface (86) of the valve sleeve-positioning piston (61) and (b) the intermediate element (84) has a recess (89) enabling application of the bolt element (87) against one of the (a) oblique surface (86) of the valve sleeve-positioning piston (61) and (b) intermmediate element (84) enclosed by the driver pin (88).

* * * * *